US011079110B2

(12) United States Patent
Barber et al.

(10) Patent No.: US 11,079,110 B2
(45) Date of Patent: Aug. 3, 2021

(54) CHILDPROOF IGNITION DEVICE

(71) Applicant: Zippo Manufacturing Company, Bradford, PA (US)

(72) Inventors: Brian J. Barber, Cyclone, PA (US); Shaun M. Panek, Bradford, PA (US)

(73) Assignee: Zippo Manufacturing Company, Bradford, PA (US)

( * ) Notice: Subject to any disclaimer, the term of this patent is extended or adjusted under 35 U.S.C. 154(b) by 103 days.

(21) Appl. No.: 16/146,653

(22) Filed: Sep. 28, 2018

(65) Prior Publication Data

US 2020/0103109 A1 Apr. 2, 2020

(51) Int. Cl.
*F23Q 2/16* (2006.01)
*F23Q 2/28* (2006.01)

(52) U.S. Cl.
CPC ..... *F23Q 2/164* (2013.01); *F23Q 2/287* (2013.01)

(58) Field of Classification Search
CPC ..... F23Q 2/164; F23Q 2/287
USPC ..... 431/153, 254, 255
See application file for complete search history.

(56) References Cited

U.S. PATENT DOCUMENTS 5,145,358 A 9/1992 Shike et al.
5,697,775 A 12/1997 Saito et al.
6,168,423 B1 1/2001 Man
6,196,833 B1 * 3/2001 Ho ..... F23D 14/38 431/153
6,666,679 B1 12/2003 Ye
6,669,466 B2 12/2003 Dijkstra
6,814,569 B2 * 11/2004 Sung ..... F23Q 2/164 431/153
6,939,129 B2 9/2005 Hsu
7,244,120 B2 7/2007 Jiang
7,581,947 B2 9/2009 Shan
7,771,191 B2 8/2010 Johnston et al.
7,967,601 B2 6/2011 Johnston et al.
8,449,290 B2 5/2013 Tsai
8,556,623 B2 10/2013 Guillou et al.
2003/0049576 A1 3/2003 Jon
2005/0053880 A1 3/2005 Kim
2008/0050686 A1 2/2008 Sewalt
2008/0057454 A1 * 3/2008 Suzuki ..... F23Q 2/16 431/153
2009/0098494 A1 * 4/2009 Aronson, II et al. ... F23D 11/36 431/153
2018/0066842 A1 3/2018 Tsai

FOREIGN PATENT DOCUMENTS

CA 2338842 A1 12/2000
CN 2556501 Y 6/2003
CN 201885257 U 6/2011

* cited by examiner

*Primary Examiner* — Avinash A Savani
(74) *Attorney, Agent, or Firm* — Hodgson Russ LLP

(57) ABSTRACT

A lighter has a safety button and an ignition trigger arranged on the lighter housing such that an activation force required to move the safety button to an activate position and an ignition force required to move the ignition trigger in an ignition direction are directed opposite to one another. The safety button is arranged on the housing for contact by the purlicue of the user's hand and the trigger is arranged on the housing for contact by a finger of the hand. Consequently, operation of the safety button is concealed during use, and the lighter is operable using only one hand.

18 Claims, 7 Drawing Sheets

CHILDPROOF IGNITION DEVICE

FIELD OF THE INVENTION

The present invention relates to childproof ignition devices for hand-held lighters.

BACKGROUND OF THE INVENTION

As used herein, the term "lighter" broadly refers to a manually operable device for igniting fuel to generate a flame, including but not limited to pocket lighters, utility lighters, torches, and the like.

It is known to provide lighters with a mechanism for resisting undesired operation of the lighter by young children. These mechanisms may include a safety switch that shuts off the fuel source or prevents movement of an operating trigger on the lighter. The safety switch may be depressible or slidable by a user to release the operating trigger for movement to operate the lighter, and is typically spring-biased to automatically return to a safety position when the user removes finger pressure from the safety switch.

In another type of safety mechanism, a piezoelectric igniter is normally located away from operative engagement with the operating trigger of the lighter, and a safety switch is operable by a user to reposition the piezoelectric igniter into operative engagement with the trigger so that operation of the trigger will cause ignition. The safety switch and/or the piezoelectric igniter may be spring-biased such that the igniter automatically returns to its original position away from operative engagement with the trigger when the user removes finger pressure from the safety switch.

A drawback of the mechanisms known to applicant is that operation of the safety switch just prior to activation of the operating trigger is a relatively conspicuous action that is readily observable by a curious child. In some cases, a user must use two different fingers, one to actuate the safety switch and another to operate the ignition trigger, making it very difficult to conceal how the lighter is operated. Consequently, the childproof nature of known lighters may endure only for a brief period of time in some households because the operating technique may be readily understood by an observant child who shares his or her knowledge with siblings and peers.

There is a need for a childproof ignition device having a manner of operation that is not readily apparent to observers, especially children, and is not easily discoverable by children experimenting with the lighter.

SUMMARY OF THE INVENTION

The present disclosure provides a lighter with a childproof ignition device having a safety button that is concealed during use from curious observers.

The lighter generally comprises a housing sized to be grasped in a hand of a user, a fuel reservoir for containing lighter fuel, a burner in communication with the fuel reservoir, and a fuel ignition system. The fuel ignition system has a safety configuration in which the fuel ignition system is inoperable to release and ignite lighter fuel from the fuel reservoir and an ignition configuration in which the fuel ignition system is operable to release and ignite lighter fuel from the fuel reservoir. The fuel ignition system is biased to normally assume the safety configuration, and includes an ignition trigger mounted on the housing for movement relative to the housing in an ignition direction to operate the fuel ignition system when the fuel ignition system is in the ignition configuration. The fuel ignition system may include a piezoelectric igniter compressible to generate a spark to ignite lighter fuel from the fuel reservoir, wherein movement of the ignition trigger in the ignition direction when the fuel ignition system is in the ignition configuration compresses the piezoelectric igniter and opens a fuel valve to ignite released fuel.

The lighter additionally comprises the aforementioned safety button, which is mounted on the housing for movement relative to the housing to an activate position to selectively reconfigure the fuel ignition system from the safety configuration to the ignition configuration. The safety button and the ignition trigger are arranged on the housing such that an activation force required to move the safety button to the activate position and an ignition force required to move the ignition trigger in the ignition direction are directed opposite to one another. The safety button may be arranged on the housing for contact by the purlicue of the user's hand and the trigger is arranged on the housing for contact by a finger of the hand. Consequently, operation of the safety button is concealed during use, and the lighter is operable using only one hand.

In a first embodiment, the fuel ignition system includes a displaceable detent member which is arranged in a lockout position to prevent movement of the ignition trigger in the ignition direction when the fuel ignition system is in the safety configuration. The detent member is coupled to the safety button such that movement of the safety button to its activate position displaces the detent member from its lockout position to a detent release position to allow movement of the ignition trigger in the ignition direction.

In a second embodiment, the ignition trigger is in operative engagement with a first end of the piezoelectric igniter, and the piezoelectric igniter travels in an uncompressed condition with the ignition trigger when the ignition trigger is moved in the ignition direction while the fuel ignition system is in the safety configuration. The safety button includes an abutment surface for engaging a second end of the piezoelectric igniter when the safety button is moved to its activate position, such that the piezoelectric igniter is compressed between the ignition trigger and the abutment surface of the safety button to generate a spark when the ignition trigger is moved in the ignition direction while the fuel ignition system is in the ignition configuration. The safety button may be movable linearly or rotatably to the activate position.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
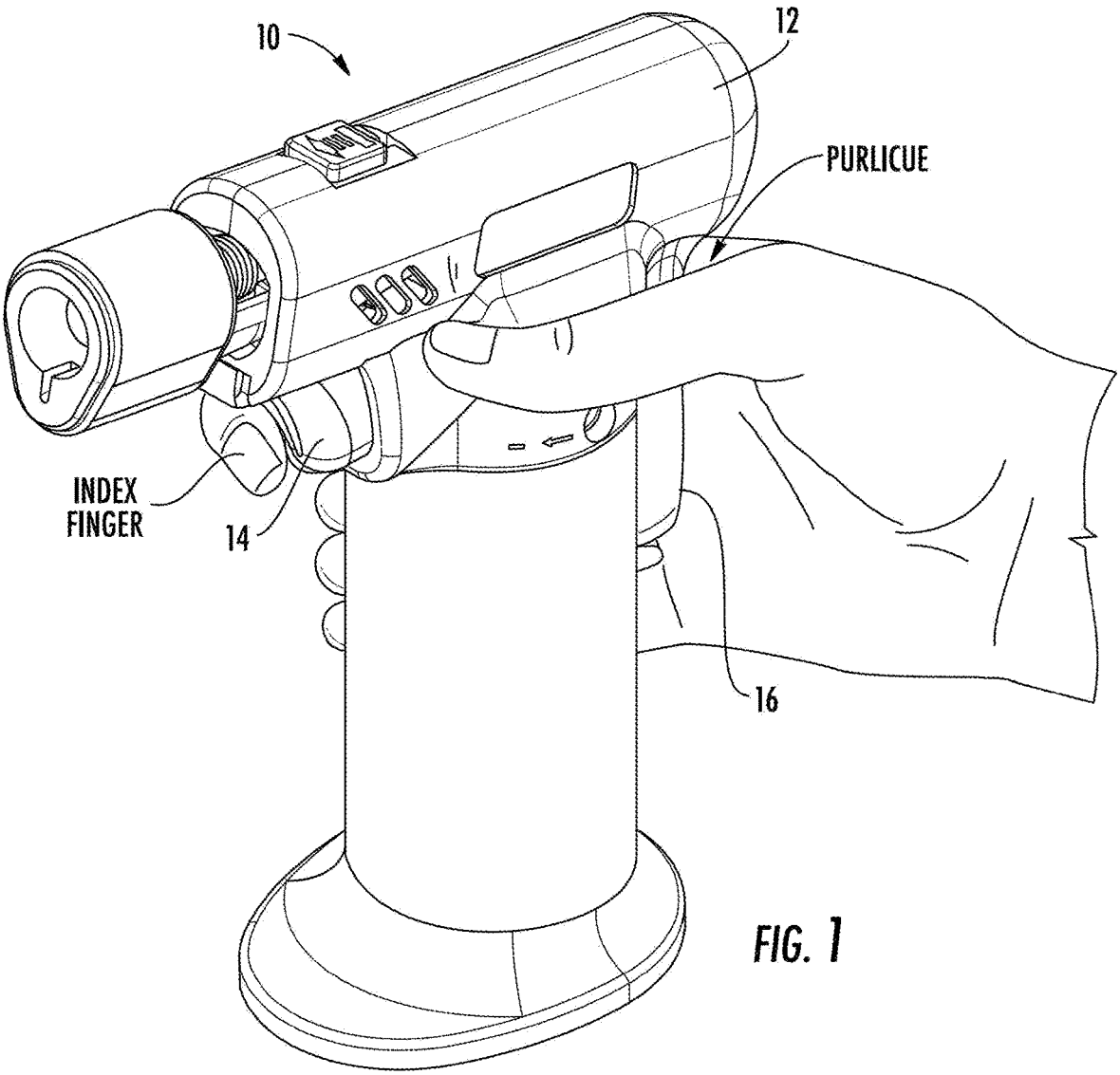
FIG. 1 is a perspective view showing a lighter formed in accordance with a first embodiment of the present invention in the hand of a user.

FIG. 1 shows a lighter 10 formed in accordance with a first embodiment of the present invention. Lighter 10 comprises a housing 12 sized to be grasped in a hand of a user as illustrated in FIG. 1. Lighter 10 also comprises an ignition trigger 14 and a safety button 16 each mounted on housing 12 for movement relative to the housing as will be described below. Ignition trigger 14 and safety button 16 are arranged on housing 12 such that when the housing is grasped in the hand of a user as intended, the safety button 16 is contacted by the purlicue (i.e. the crotch between the thumb and index finger) of the user's hand and the ignition trigger 14 is contacted by a finger of the user's hand, for example the index finger as depicted in FIG. 1.

Figure 2:
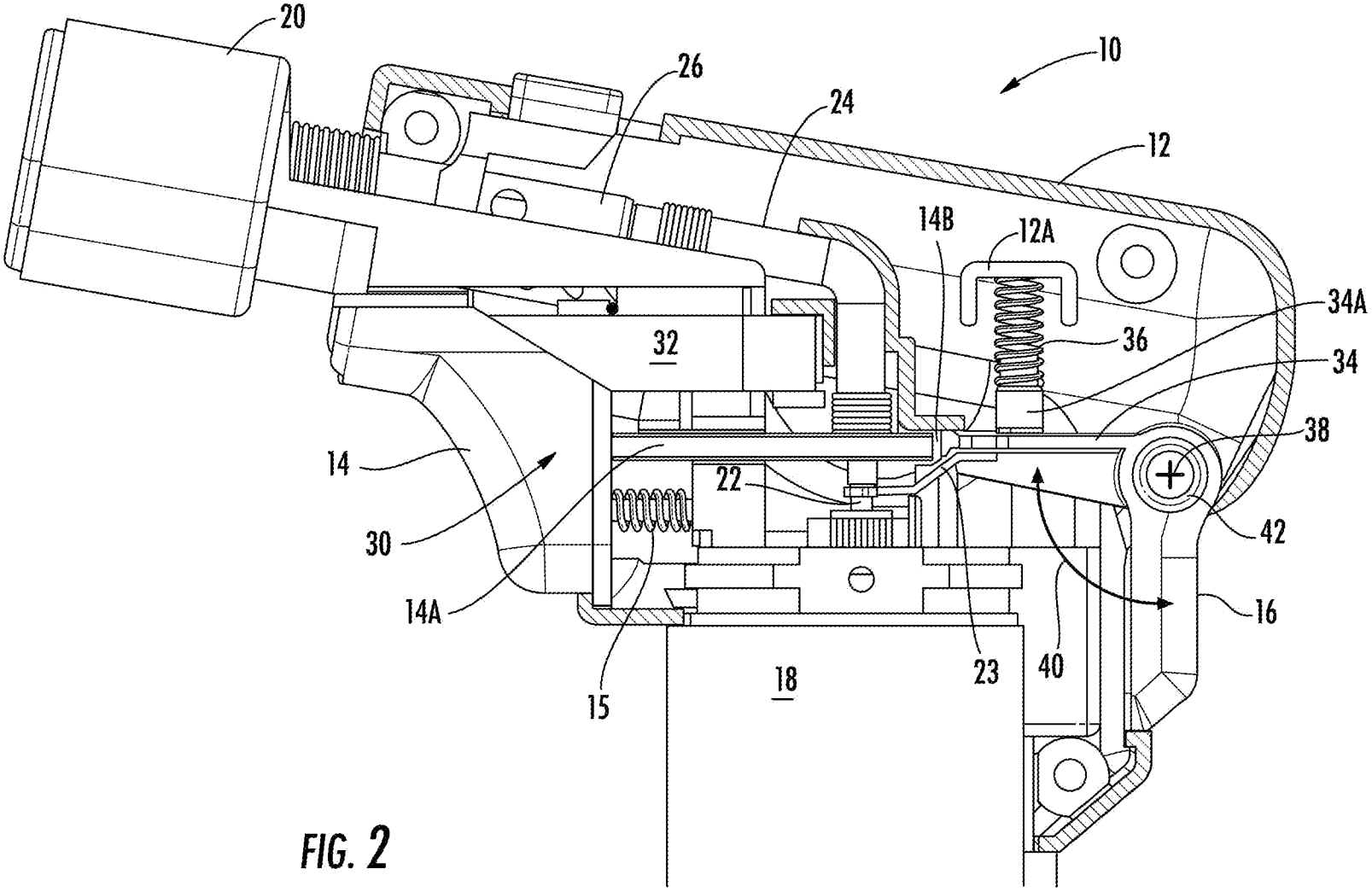
FIG. 2 is a cross-sectional view of the lighter shown in FIG. 1, wherein a fuel ignition system of the lighter is in a safety configuration thereof.

Reference is now made to FIG. 2, which shows internal structure of lighter 10 within housing 12. Lighter 10 comprises a fuel reservoir 18 for containing lighter fuel, and a burner 20 in communication with fuel reservoir 18 by way of a fuel valve 22, a fuel conduit 24, and a burner tube 26.

Figure 3A:
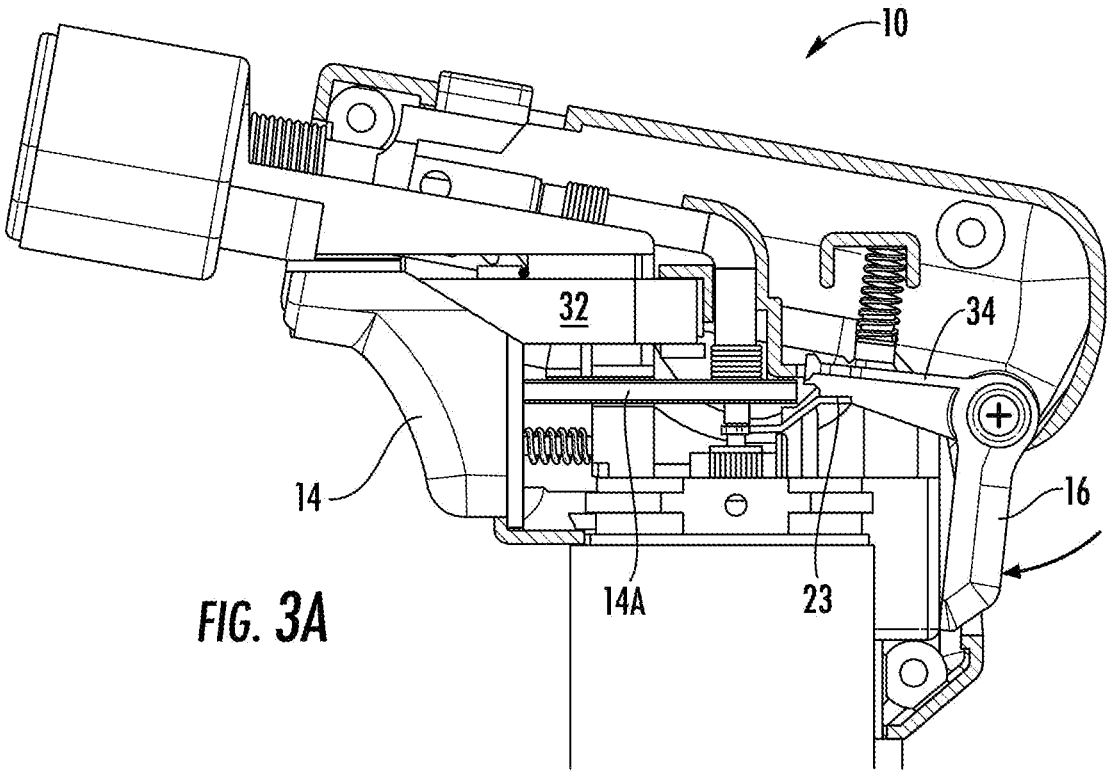
FIG. 3A is a view similar to that of FIG. 2, wherein the fuel ignition system is in an ignition configuration thereof prior to user actuation of an ignition trigger of the lighter.
Figure 3B:
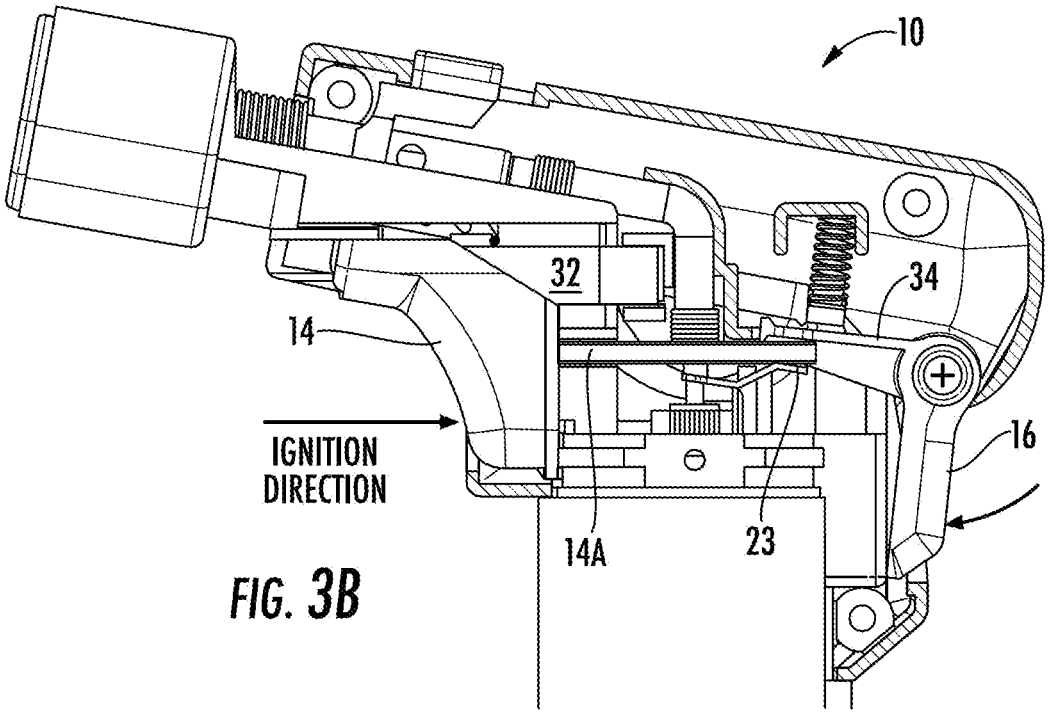
FIG. 3B is a view similar to that of FIG. 3A, wherein the ignition trigger of the lighter has been actuated by a user.

Lighter 10 further comprises a fuel ignition system generally identified by reference numeral 30. Fuel ignition system 30 has a safety configuration, illustrated in FIG. 2, in which the fuel ignition system 30 is inoperable to release and ignite lighter fuel from fuel reservoir 18. Fuel ignition system 30 also has an ignition configuration, illustrated in FIG. 3A, in which the fuel ignition system 30 is operable to release and ignite lighter fuel from fuel reservoir 18. For example, fuel ignition system 30 may include a piezoelectric igniter 32 compressible to generate a spark to ignite lighter fuel released from fuel reservoir 18 upon opening of fuel valve 22. As illustrated in FIG. 3B, when fuel ignition system 30 is in its ignition configuration, movement of ignition trigger 14 in an ignition direction (e.g. left to right in FIG. 3B) compresses piezoelectric igniter 32 and actuates a fuel valve lever 23 to open fuel valve 22, whereby a spark is generated to ignite fuel released from fuel reservoir 18. A trigger reset spring 15 may be arranged to act between housing 12 and trigger 14 to urge trigger 14 in a reset direction opposite the ignition direction.

Fuel ignition system 30 may include a displaceable detent member 34. When fuel ignition system 30 is in its safety configuration shown in FIG. 2, detent member 34 is arranged in a lockout position to prevent movement of ignition trigger 14 in the ignition direction and thereby render fuel ignition system 30 inoperable. For example, ignition trigger 14 may include an extension arm 14A for actuating fuel valve lever 23 upon movement of ignition trigger in the ignition direction to open fuel valve 22, and detent member 34 may be arranged to abut with a distal end 14B of extension arm 14A when fuel ignition system 30 is in its safety configuration to prevent movement of ignition trigger 14 in the ignition direction.

Detent member 34 may be directly or indirectly coupled to safety button 16 such that movement of the safety button by a user causes displacement of the detent member. As shown in FIGS. 2, 3A, and 3B, detent member 34 and safety button 16 may be rotatably mounted to housing 12 to pivot relative to the housing about a single pivot axis 38. In the illustrated embodiment, safety button 16 and detent member 34 extend radially outward from pivot axis 38 and are angularly spaced from one another about pivot axis 38 by a spacing angle 40. The spacing angle 40 may be approximately ninety degrees as shown in FIG. 2, or it may be some other suitable angle. Detent member 34 and safety button 16 may be integrally formed with one another from plastic as a one-piece molded part having a hub 42 for rotatable mounting to housing 12. Alternatively, detent member 34 and safety button 16 may be formed as separate parts and connected to one another by direct attachment or through one or more intervening parts.

Fuel ignition system 30 may be biased to normally assume the safety configuration shown in FIG. 2. Movement of safety button 16 to an activate position, as shown in FIG. 3A, displaces detent member 34 from its lockout position (FIG. 2) to a detent release position (FIG. 3A) away from trigger extension arm 14A to allow movement of ignition trigger 14 in the ignition direction. Fuel ignition system 30 may include a safety spring 36 arranged to urge detent member 34 toward the lockout position such that fuel ignition system 30 is biased to normally assume the safety configuration. Safety spring 36 may be embodied as a coil spring acting between an internal shelf 12A in housing 12 and a stem 34A protruding from detent member 34. Safety spring 36 may be embodied by another type of spring, for example a torsion spring or a leaf spring, arranged to urge detent member 34 in a counter-clockwise pivot direction about pivot axis 38 in the view of FIG. 2.

As will be understood from the foregoing description, safety button 16 and ignition trigger 14 are arranged on housing 12 such that an activation force required to move safety button 16 to the activate position and an ignition force required to move ignition trigger 14 in the ignition direction are directed opposite to one another. Lighter 10 can therefore be operated with one hand by drawing the index finger on ignition trigger 14 toward the purlicue region of the hand in contact with safety button 16. Initially, when opposing forces are first applied by the index finger and purlicue, ignition trigger will be prevented from movement in the ignition direction as distal end 14B of extension arm 14A abuts with detent member 34. As the opposing forces applied by the index finger and purlicue increase to a predetermined force level, safety button 16 will be displaced to its activate position to reconfigure fuel ignition system 30 from its safety configuration (FIG. 2) to its ignition configuration (FIG. 3A). Continued application of force by the user will then cause ignition trigger 14 to move in the ignition direction as shown in FIG. 3B to release and ignite fuel as described above.

As may be understood, operation of safety button 16 is concealed by the user's hand, and the distance from the outer surface of safety button 16 to the outer surface of ignition trigger 14 may be made relatively large to fit an adult's hand but not a child's hand. A child observing operation of lighter 10 by an adult will see that ignition trigger 14 is actuated, but will not see actuation of safety button 16. When the child attempts to use lighter 10 by replicating the observed operating technique, the child will be frustrated because the ignition trigger will not move far enough to cause ignition. The child will not be inclined toward possible two-handed operation of lighter 10 because this would be a departure from the observed operating technique.

Figure 4:
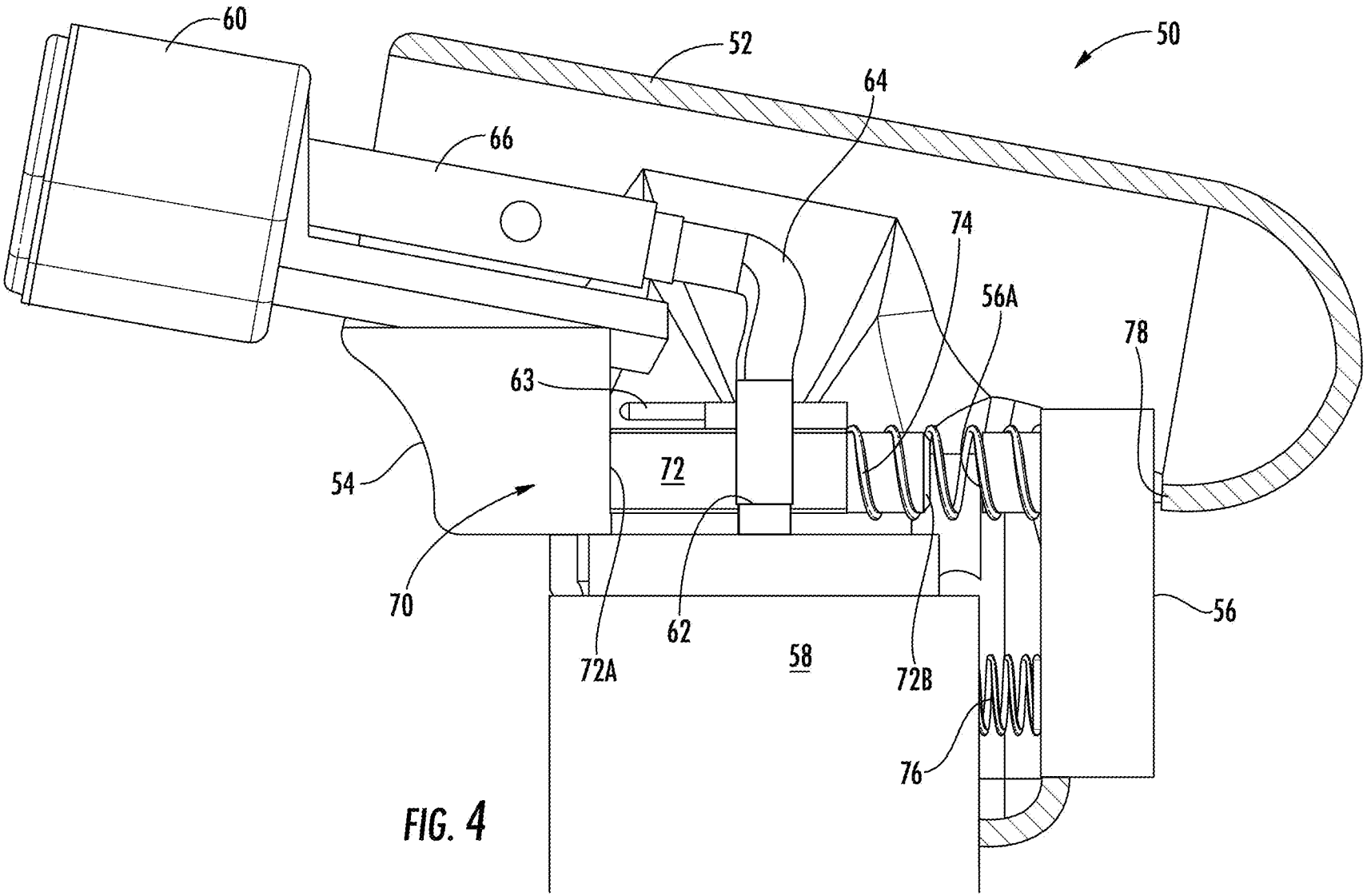
FIG. 4 is a cross-sectional view of a lighter formed in accordance with a second embodiment of the present invention, wherein a fuel ignition system of the lighter is in a safety configuration thereof.
Figure 5A:
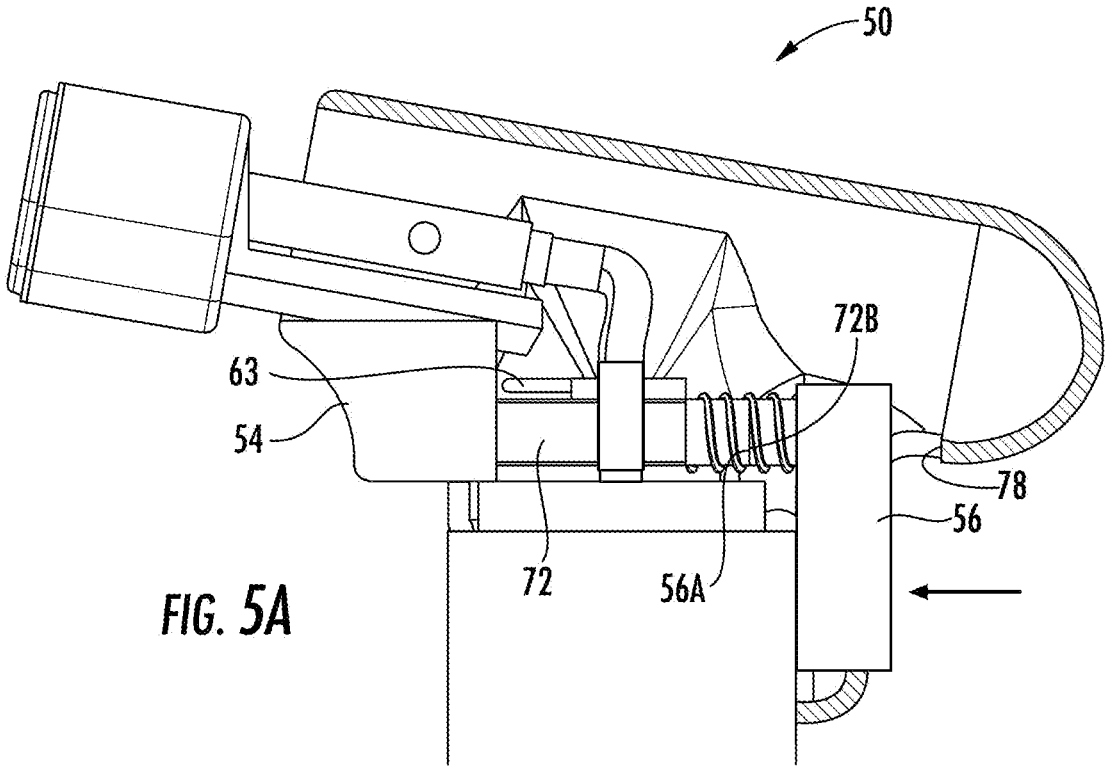
FIG. 5A is a view similar to that of FIG. 4, wherein the fuel ignition system is in an ignition configuration thereof prior to user actuation of an ignition trigger of the lighter.
Figure 5B:
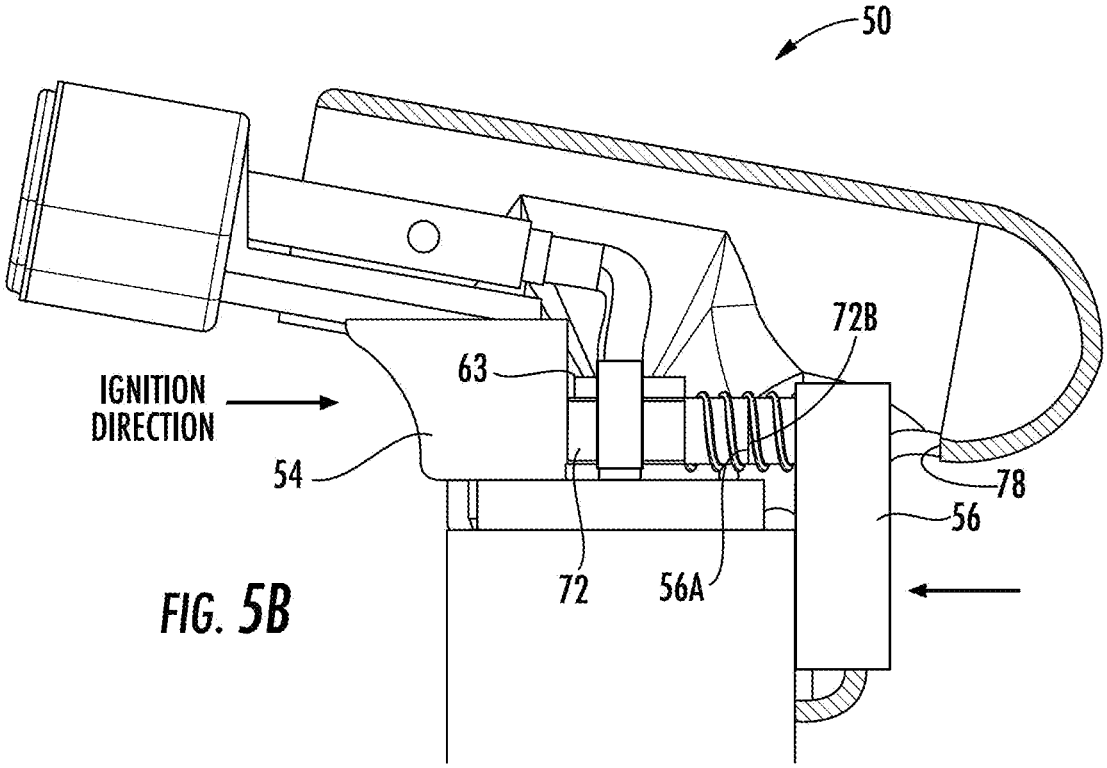
FIG. 5B is a view similar to that of FIG. 5A, wherein the ignition trigger of the lighter has been actuated by a user.

FIGS. 4-5B show a lighter 50 formed in accordance with a second embodiment of the present invention. Lighter 50 differs from lighter 10 with respect to the safety configuration and ignition configuration of the fuel ignition system. In lighter 50 of the second embodiment, the ignition trigger is allowed to travel in both the safety and ignition configurations, but compression of the piezoelectric igniter only occurs in the ignition configuration and not in the safety configuration.

Lighter 50 is generally similar to lighter 10 of the first embodiment in that lighter 50 comprises a housing 52 sized to be grasped in a hand of a user, and an ignition trigger 54 and a safety button 56 each mounted on housing 52 for movement relative to the housing. Ignition trigger 54 and safety button 56 are arranged on housing 52 such that when the housing is grasped in the hand of a user as intended, the safety button 56 is contacted by the purlicue of the user's hand and the ignition trigger 14 is contacted by a finger of the user's hand, for example the index finger as illustrated in FIG. 1 with respect to the first embodiment.

Lighter 50 comprises a fuel reservoir 58 for containing lighter fuel, and a burner 60 in communication with fuel reservoir 58 by way of a fuel valve 62, a fuel conduit 64, and a burner tube 66. Lighter 50 further comprises a fuel ignition system 70.

Fuel ignition system 70 has a safety configuration, illustrated in FIG. 4, in which the fuel ignition system 70 is inoperable to release and ignite lighter fuel from fuel reservoir 58. Fuel ignition system 70 also has an ignition configuration, illustrated in FIG. 5A, in which the fuel ignition system 70 is operable to release and ignite lighter fuel from fuel reservoir 58. Like fuel ignition system 30 of the first embodiment, fuel ignition system 70 may include a piezoelectric igniter 72 compressible to generate a spark to ignite lighter fuel released from fuel reservoir 58 upon opening of fuel valve 62. As illustrated in FIG. 5B, when fuel ignition system 70 is in its ignition configuration, movement of ignition trigger 54 in an ignition direction (e.g. left to right in FIG. 5B) compresses piezoelectric igniter 72 and actuates a fuel valve lever 63 to open fuel valve 62, whereby a spark is generated to ignite fuel released from fuel reservoir 58.

Ignition trigger 54 is in operative engagement with a first end 72A of piezoelectric igniter 72, and the piezoelectric igniter travels in an uncompressed condition with ignition trigger 54 when the ignition trigger is moved in the ignition direction while the fuel ignition system is in the safety configuration. Piezoelectric igniter 72 remains uncompressed because ignition trigger 54 has a limited range of travel in the ignition direction, and a second end 72B of the piezoelectric igniter is not held or abutted by opposing structure in this limited range of travel.

Safety button 56 is movable relative to housing 52 to an activate position, shown in FIG. 5A, to selectively reconfigure fuel ignition system 70 from the safety configuration to the ignition configuration. Safety button 56 includes an abutment surface 56A for engaging the second end 72B of piezoelectric igniter 72 when safety button 56 is in the activate position, whereby the piezoelectric igniter is compressed between ignition trigger 54 and the abutment surface 56A of safety button 56 as illustrated in FIG. 5B to generate a spark when the ignition trigger 54 is moved in the ignition direction while the fuel ignition system 70 is in the ignition configuration.

Safety button 56 may be mounted on housing 52 to move linearly to the activate position. Safety button 56 may be biased away from the activate position by one or more springs 74, 76. Spring 74 may be arranged to act between piezoelectric igniter 72 and an inwardly facing surface of safety button 56 to urge an upper portion of safety button 56 outward against a limit surface 78 of housing 52, and to urge piezoelectric igniter 72 and ignition trigger 54 in a reset direction opposite the ignition direction. Spring 76 may be arranged to act between housing 52 or structure fixed within housing 52 (e.g. fuel reservoir 58) and an inwardly facing surface of safety button 56 to urge a lower portion of safety button 56 in an outward direction. As will be understood, the action of springs 74, 76 biases fuel ignition system 70 to normally assume the safety configuration shown in FIG. 4.

Similar to the first embodiment, safety button 56 and ignition trigger 54 are arranged on housing 52 such that an activation force required to move safety button 56 to the activate position and an ignition force required to move ignition trigger 54 in the ignition direction are directed opposite to one another. Operation of lighter 50 is therefore similar to operation of lighter 10 described above, and achieves the same childproofing benefits already mentioned.

Figure 6:
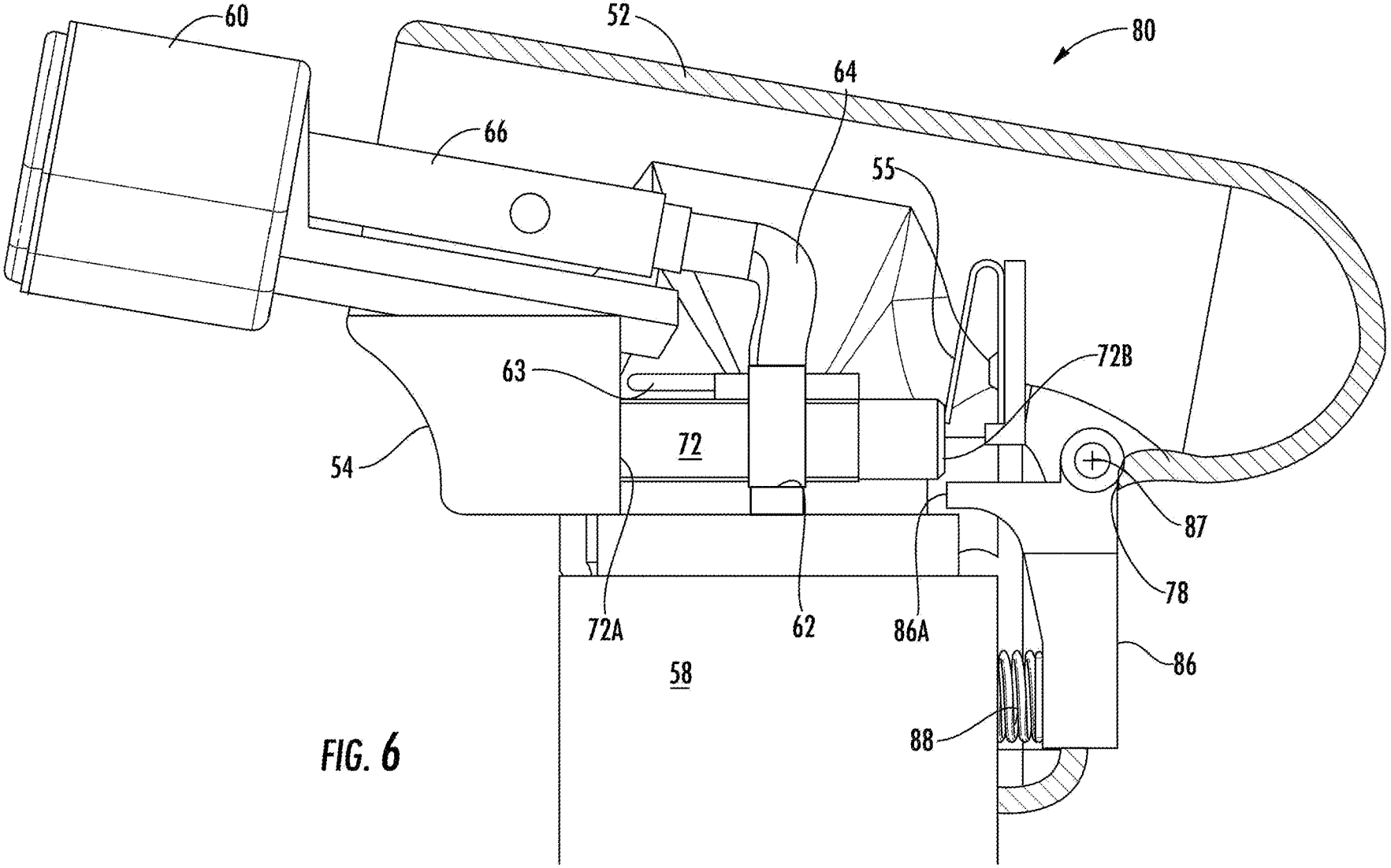
FIG. 6 is a cross-sectional view illustrating a variation of the lighter shown in FIG. 4, wherein a fuel ignition system of the lighter is in a safety configuration thereof.
Figure 7A:
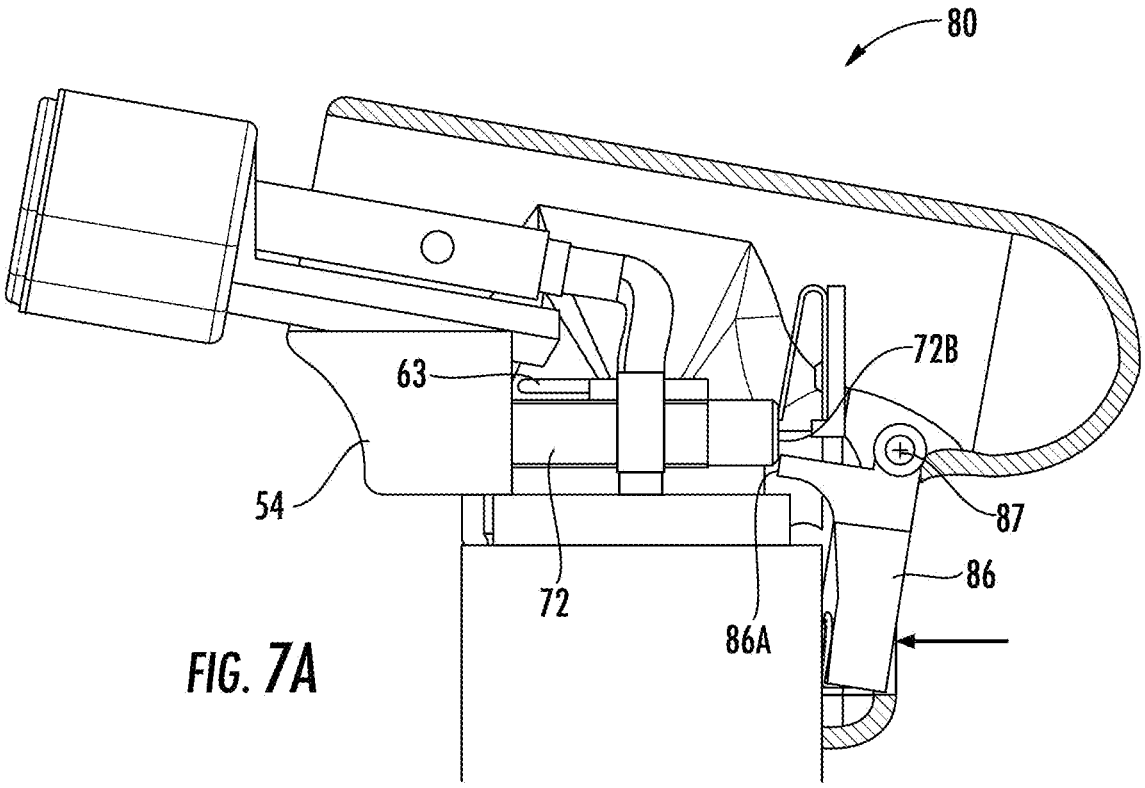
FIG. 7A is a view similar to that of FIG. 6, wherein the fuel ignition system is in an ignition configuration thereof prior to user actuation of an ignition trigger of the lighter.
Figure 7B:
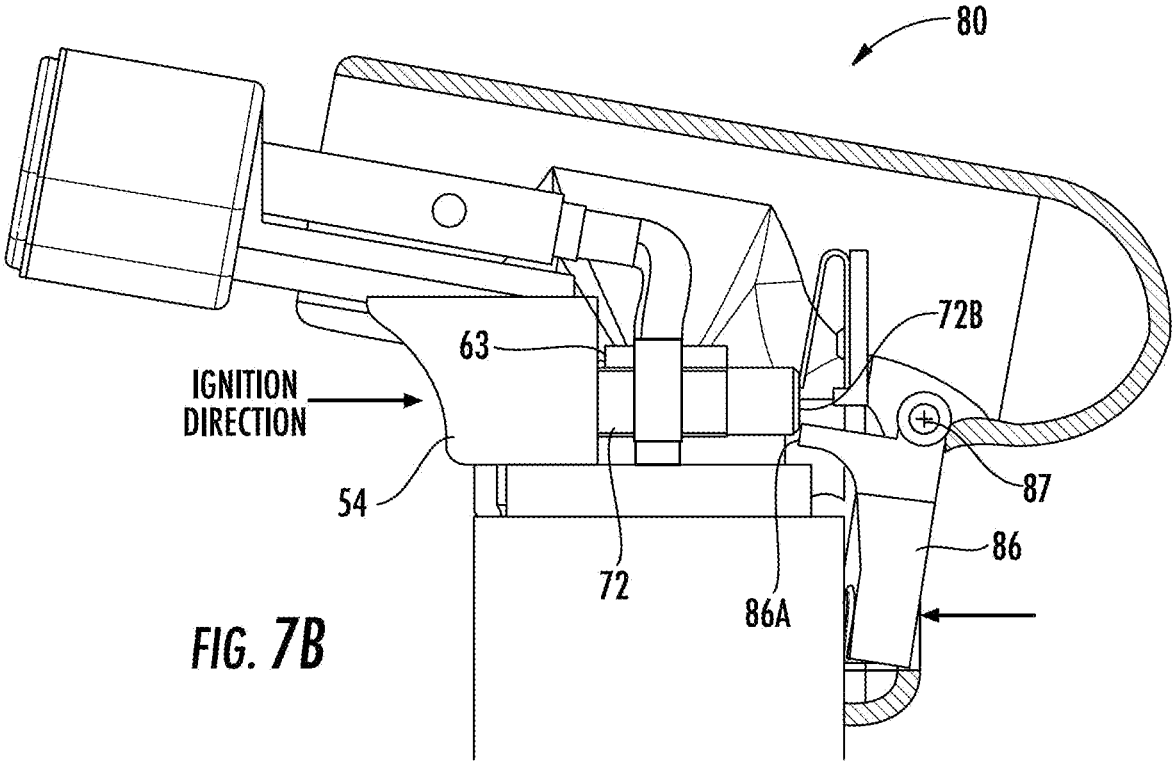
FIG. 7B is a view similar to that of FIG. 7A, wherein the ignition trigger of the lighter has been actuated by a user.

FIGS. 6-7B depict a lighter 80 very similar in design and operation to lighter 50, but incorporating variations in the safety button and the biasing springs. Fuel ignition system 70 is shown in its safety configuration in FIG. 6. Instead of a linearly movable safety button, lighter 80 has a rotatable safety button 86 mounted on housing 52 to pivot about a pivot axis 87 to an activate position to reconfigure fuel ignition system 70 from its safety configuration to its ignition configuration, shown in FIG. 7A. Safety button 86 includes a curved upper portion on which an abutment surface 86A is provided for engaging the second end 72B of piezoelectric igniter 72 when safety button 86 is pivoted to its activate position. As a result, when ignition trigger 54 is moved in the ignition direction while safety button 86 is in its activate position, piezoelectric igniter 72 is compressed between ignition trigger 54 and abutment surface 86A of safety button 86 as illustrated in FIG. 7B to generate a spark. The same motion of ignition trigger 54 in the ignition direction may also actuate fuel valve lever 63 to open fuel valve 62. Safety button 86 may be biased away from its activate position by a safety spring 88 arranged to act between housing 52 or structure fixed within housing 52 (e.g. fuel reservoir 58) and an inwardly facing surface of safety button 86 below pivot axis 87 to urge safety button 86 to pivot in a counter-clockwise direction as viewed in FIGS. 6-7B. Alternatively, safety spring 88 may be embodied as a torsion spring arranged about pivot axis 87 acting to urge safety button 86 to pivot in a counter-clockwise direction as viewed in FIGS. 6-7B. A trigger reset spring 55 may be arranged to act between housing 52 and the second end 72B of piezoelectric igniter 72 to urge piezoelectric igniter 72 and trigger 54 in a reset direction opposite the ignition direction (i.e. right to left as viewed in FIGS. 6-7B). Trigger reset spring 55 may be a leaf spring as shown in the figures, or another type of spring such as a coil spring or a torsion spring.

Safety button 56 shown in FIGS. 4-5B, and safety button 86 shown in FIGS. 6-7B, may be manufactured from plastic as a one-piece molded part.

As may be appreciated from the foregoing description, the present disclosure provides a childproof ignition device for a lighter that is both simple to manufacture and effective for child safety. A further advantage is that the lighter may be operated with only one hand.

While the invention has been described in connection with exemplary embodiments, the detailed description is not intended to limit the scope of the invention to the particular forms set forth. The invention is intended to cover such alternatives, modifications and equivalents of the described embodiment as may be included within the scope of the claims.

What is claimed is:

1. A lighter comprising:

a housing sized to be grasped in a hand of a user;

a fuel reservoir for containing lighter fuel;

a burner in communication with the fuel reservoir;

a fuel ignition system having a safety configuration in which the fuel ignition system is inoperable to release and ignite lighter fuel from the fuel reservoir and an ignition configuration in which the fuel ignition system is operable to release and ignite lighter fuel from the fuel reservoir, wherein the fuel ignition system is biased to normally assume the safety configuration, and wherein the fuel ignition system includes an ignition trigger mounted on the housing for movement relative to the housing in an ignition direction toward a rear of the housing to operate the fuel ignition system when the fuel ignition system is in the ignition configuration; and a safety button mounted on the housing for movement relative to the housing toward a front of the housing to an activate position to selectively reconfigure the fuel ignition system from the safety configuration to the ignition configuration;

wherein the safety button and the ignition trigger are arranged on the housing such that an activation force required to move the safety button to the activate position is directed toward the front of the housing and an ignition force required to move the ignition trigger in the ignition direction is directed toward the rear of the housing;

wherein the safety button is arranged on the housing such that the activation force is applied by the purlicue of the hand and the trigger is arranged on the housing such that the ignition force is applied by a finger of the hand.

2. The lighter according to claim 1, wherein the fuel ignition system includes a displaceable detent member, the detent member being arranged in a lockout position to prevent movement of the ignition trigger in the ignition direction and thereby render the fuel ignition system inoperable when the fuel ignition system is in the safety configuration, and the detent member being arranged in a detent release position to allow movement of the ignition trigger in the ignition direction to operate the fuel ignition system when the fuel ignition system is in the ignition configuration.

3. A lighter comprising:

a housing sized to be grasped in a hand of a user;

a fuel reservoir for containing lighter fuel;

a burner in communication with the fuel reservoir;

a fuel ignition system having a safety configuration in which the fuel ignition system is inoperable to release and ignite lighter fuel from the fuel reservoir and an ignition configuration in which the fuel ignition system is operable to release and ignite lighter fuel from the fuel reservoir, wherein the fuel ignition system is biased to normally assume the safety configuration, and wherein the fuel ignition system includes an ignition trigger mounted on the housing for movement relative to the housing in an ignition direction to operate the fuel ignition system when the fuel ignition system is in the ignition configuration; and a safety button mounted on the housing for movement relative to the housing to an activate position to selectively reconfigure the fuel ignition system from the safety configuration to the ignition configuration;

wherein the safety button and the ignition trigger are arranged on the housing such that an activation force required to move the safety button to the activate position and an ignition force required to move the ignition trigger in the ignition direction are directed opposite to one another;

wherein the fuel ignition system includes a displaceable detent member, the detent member being arranged in a lockout position to prevent movement of the ignition trigger in the ignition direction and thereby render the fuel ignition system inoperable when the fuel ignition system is in the safety configuration, and the detent member being arranged in a detent release position to allow movement of the ignition trigger in the ignition direction to operate the fuel ignition system when the fuel ignition system is in the ignition configuration;

wherein the lighter further comprises a trigger reset spring arranged to urge the ignition trigger in a direction opposite from the ignition direction.

4. The lighter according to claim 3, wherein the burner is in communication with the fuel reservoir by way of a fuel valve having a valve lever, and the ignition trigger includes an extension arm for actuating the valve lever upon movement of the ignition trigger in the ignition direction to open the fuel valve.

5. The lighter according to claim 4, wherein the detent member is arranged to abut with an end of the extension arm when the fuel ignition system is in the safety configuration to prevent movement of the ignition trigger in the ignition direction.

6. The lighter according to claim 3, wherein the fuel ignition system includes a piezoelectric igniter compressible to generate a spark to ignite lighter fuel from the fuel reservoir.

7. The lighter according to claim 6, wherein movement of the ignition trigger in the ignition direction compresses the piezoelectric igniter to generate the spark.

8. A lighter comprising:

a housing sized to be grasped in a hand of a user;

a fuel reservoir for containing lighter fuel;

a burner in communication with the fuel reservoir;

a fuel ignition system having a safety configuration in which the fuel ignition system is inoperable to release and ignite lighter fuel from the fuel reservoir and an ignition configuration in which the fuel ignition system is operable to release and ignite lighter fuel from the fuel reservoir, wherein the fuel ignition system is biased to normally assume the safety configuration, and wherein the fuel ignition system includes an ignition trigger mounted on the housing for movement relative to the housing in an ignition direction to operate the fuel ignition system when the fuel ignition system is in the ignition configuration; and a safety button mounted on the housing for movement relative to the housing to an activate position to selectively reconfigure the fuel ignition system from the safety configuration to the ignition configuration;

wherein the safety button and the ignition trigger are arranged on the housing such that an activation force required to move the safety button to the activate position and an ignition force required to move the ignition trigger in the ignition direction are directed opposite to one another;

wherein the fuel ignition system includes a piezoelectric igniter compressible to generate a spark to ignite lighter fuel from the fuel reservoir, the ignition trigger is in operative engagement with a first end of the piezoelectric igniter, and the piezoelectric igniter travels in an uncompressed condition with the ignition trigger when the ignition trigger is moved in the ignition direction while the fuel ignition system is in the safety configuration.

9. The lighter according to claim 8, wherein the safety button includes an abutment surface for engaging a second end of the piezoelectric igniter when the safety button is in the activate position, and the piezoelectric igniter is compressed between the ignition trigger and the abutment surface of the safety button to generate a spark when the ignition trigger is moved in the ignition direction while the fuel ignition system is in the ignition configuration.

10. The lighter according to claim 9, wherein the safety button is mounted on the housing to move linearly to the activate position.

11. The lighter according to claim 9, wherein the safety button is mounted on the housing to pivot to the activate position.

12. The lighter according to claim 9, wherein the fuel ignition system is biased to normally assume the safety configuration by a safety spring arranged to urge the safety button away from the activate position.

13. The lighter according to claim 3, wherein the detent member is coupled to the safety button such that movement of the safety button to the activate position displaces the detent member to the detent release position.

14. The lighter according to claim 3, wherein the fuel ignition system is biased to normally assume the safety configuration by a safety spring arranged to urge the detent member toward the lockout position.

15. The lighter according to claim 13, wherein the detent member and the safety button are rotatably mounted to the housing to pivot about a single pivot axis relative to the housing.

16. The lighter according to claim 15, wherein the safety button and detent member extend radially outward from the single pivot axis, and wherein the safety button and detent member are angularly spaced from one another about the single pivot axis by a spacing angle.

17. The lighter according to claim 16, wherein the spacing angle is approximately 90 degrees.

18. The lighter according to claim 13, wherein the detent member and the safety button are integrally formed with one another as a one-piece molded part.

* * * * *